US005221841A

United States Patent [19]

Nagai et al.

[11] Patent Number: 5,221,841

[45] Date of Patent: Jun. 22, 1993

[54] FAST ATOM BEAM SOURCE

[75] Inventors: Kazutoshi Nagai, Tokyo; Kanichi Itoh, Kanagawa, both of Japan

[73] Assignee: Ebara Corporation, Tokyo, Japan

[21] Appl. No.: 752,785

[22] Filed: Aug. 30, 1991

[30] Foreign Application Priority Data

Aug. 30, 1990 [JP] Japan ..... 2-226486

[51] Int. Cl.[5] ..... H05H 3/02

[52] U.S. Cl. ..... 250/251; 250/396 R

[58] Field of Search ..... 250/251, 396 R

[56] References Cited

U.S. PATENT DOCUMENTS 3,846,636 11/1974 Zehr et al. ..... 250/251
4,818,872 4/1989 Parker et al. ..... 250/396 R
4,916,311 4/1990 Fuzishita et al. ..... 250/251

FOREIGN PATENT DOCUMENTS 2-100299 4/1990 Japan ..... 250/251

OTHER PUBLICATIONS

Gohda, H. et al., "SIMS Analysis of Insulating Materials Using A New Type Electron Neutralizing Gun", Materials for the 54th Study Meeting of the Japan Society for the Promotion of Sciences, No. 604, pp. 46–51 (Dec. 1987).

*Primary Examiner*—Jack I. Berman
*Attorney, Agent, or Firm*—Wenderoth, Lind & Ponack

[57] ABSTRACT

A fast atom beam source used e.g., for sputtering, includes an ion source that emits an ion beam and an electron gun that emits an electron beam at a speed substantially equal to the speed of the ions in the ion beam emitted from the ion source and in the same direction as that of the ion beam. The fast atom beam source may also include a speed control for regulating the speed of the electrons in the electron beam emitted from said electron gun to a level substantially equal to that of the speed of the ions in the ion beam, and a deflector which aligns the electron beam with the ion beam.

5 Claims, 3 Drawing Sheets

FAST ATOM BEAM SOURCE

BACKGROUND OF THE INVENTION

The present invention relates to a fast atom beam source for producing a fast atom beam that is used for sputtering, for example.

FIG. 4 shows the arrangement of a fast atom beam source which has heretofore been known. In the figure, reference numeral 1 denotes a hollow, cylindrical casing having a central portion with an enlarged diameter, 2 a circular filament for emitting thermal electrons, 3 an ion beam 4 a fast atom beam, 5 a power supply for heating the filament 2, 6 a DC bias power supply, and 7 an ion source.

The circular filament 2 is incorporated in the enlarged-diameter central portion of the casing 1. The filament 2 is disposed in such a manner that the center of its circular configuration is coincident with the axis of the casing 1. The filament 2 is connected with the heating power supply 5. p The DC bias power supply 6 is connected between the casing 1 and the filament 2 to bias the casing 1 to a potential which is several V lower than the potential of the filament 2.

The ion source 7 is disposed so that the ion beam 3 emitted therefrom enters the inside of the casing 1.

It should be noted that the constituent elements, exclusive of the power supplies 5 and 6, are accommodated in a vacuum container (not shown).

The fast atom beam source thus arranged operates as follows.

When the filament 2 is heated by the heating power supply 5, a large number of thermal electrons are emitted therefrom. The thermal electrons are repelled by the wall of the casing 1 biased to a potential lower than the potential of the filament 2, so that the thermal electrons concentrate near the axis of the casing 1, thus forming a high density electron cloud there. When the ion beam 3 that is emitted from the ion source 7 enters the electron cloud, collision and recombination between ions and electrons occur, so that the ion beam 3 is converted into a fast atom beam 4.

In the collision between ions and electrons that occur in the above process, since the mass of electrons is much smaller than the mass of ions, the ions deliver the kinetic energy to the atoms without a substantial loss, thus producing a fast atom beam 4.

However, in the conventional fast atom beam source with the above-described arrangement, the relative velocity between the electrons in the electron cloud and the ions in the ion beam is large and the recombination cross section of ions and electrons is small, so that it is difficult to produce a fast atom beam efficiently.

SUMMARY OF THE INVENTION

In view of the above-described circumstances, it is an object of the present invention to provide a fast atom beam source that produces a fast atom beam efficiently by improving the ion-electron recombination efficiency.

To attain the above-described object, the present invention provides a fast atom beam source comprising: an ion source that emits an ion beam; and an electron gun that emits an electron beam at a speed substantially equal to the speed of the ions in the ion beam emitted from the ion source and in the same direction as that of the ion beam, the electron gun further having the function of mixing the electron beam with the ion beam. The electron gun comprises a circular filament which surrounds the ion beam and emits a thermal electron beam and an electron accelerating grid which has a funnel-like configuration arranged such that the ion beam can pass through the central portion thereof and which accelerates the electron beam emitted from said circular filament while converging it toward the ion beam.

In addition, the present invention provides a fast atom beam source comprising: an ion source that emits an ion beam; an electron gun that emits an electron beam; speed control means for controlling the speed of the electrons in the electron beam emitted from the electron gun to a level substantially equal to that of the speed of the ions in the ion beam emitted from the ion source; and means for deflecting the speed-controlled electron beam by the action of an electric field or a magnetic field so that the electron beam is aligned with the direction of the ion beam and then mixed with it. The electron gun emits a thermal electron beam at approximately right angles to the ion beam, and the means for deflection comprises a magnet which deflects the electron beam so that said electron beam is aligned with the direction of the ion beam. Alternatively, the means for deflection may comprise two opposing arcuate electrodes which are disposed such that said electron beam is emitted into the area defined therebetween and the surface of the outer arcuate electrode is provided with an ion entrance orifice to allow the ion beam to pass therethrough.

More specifically, after the electron beam is aligned in the direction of the ion beam and the speed of the electrons in the electron beam is controlled to a level substantially equal to the speed of the ions in the ion beam, the electron beam is mixed with the ion beam, thereby realizing the above-described object of the present invention.

After the electrons are aligned with the direction of the ion beam and the speed of the electrons is controlled to a level substantially equal to the speed of the ions in the ion beam, the electron beam is mixed with the ion beam, thereby reducing the relative velocity between the ions and electrons. Consequently, the recombination cross section of ions and electrons increases, so that the fast atom beam production efficiency is improved.

DETAILED DESCRIPTION OF THE PREFERRED EMBODIMENTS

Embodiments of the present invention will be described below with reference to the drawings.

Figure 1:
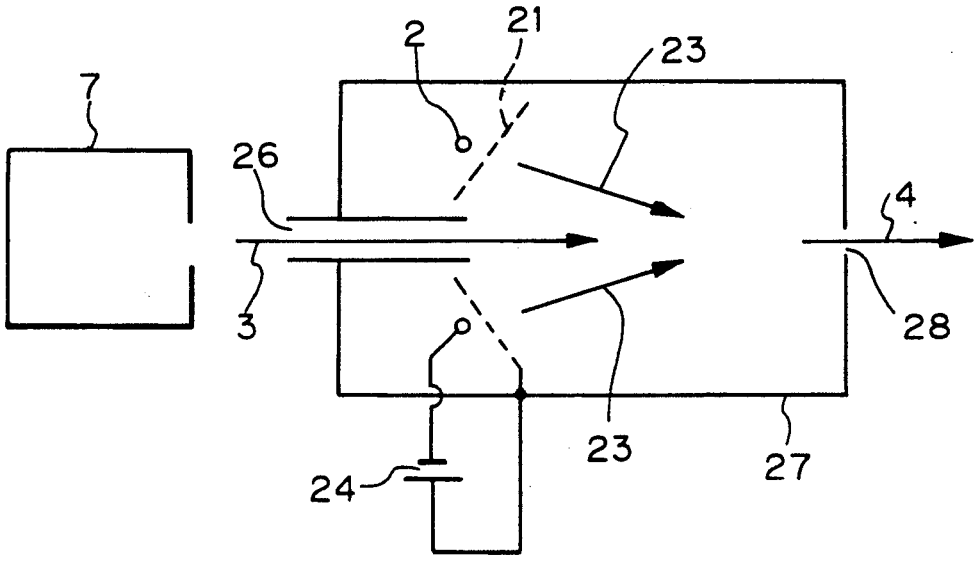
FIG. 1 is a schematic diagram of an embodiment of a fast atom beam source according to the present invention.

FIG. 1 shows a fast atom beam source according to one embodiment of the present invention.

Figure 4:
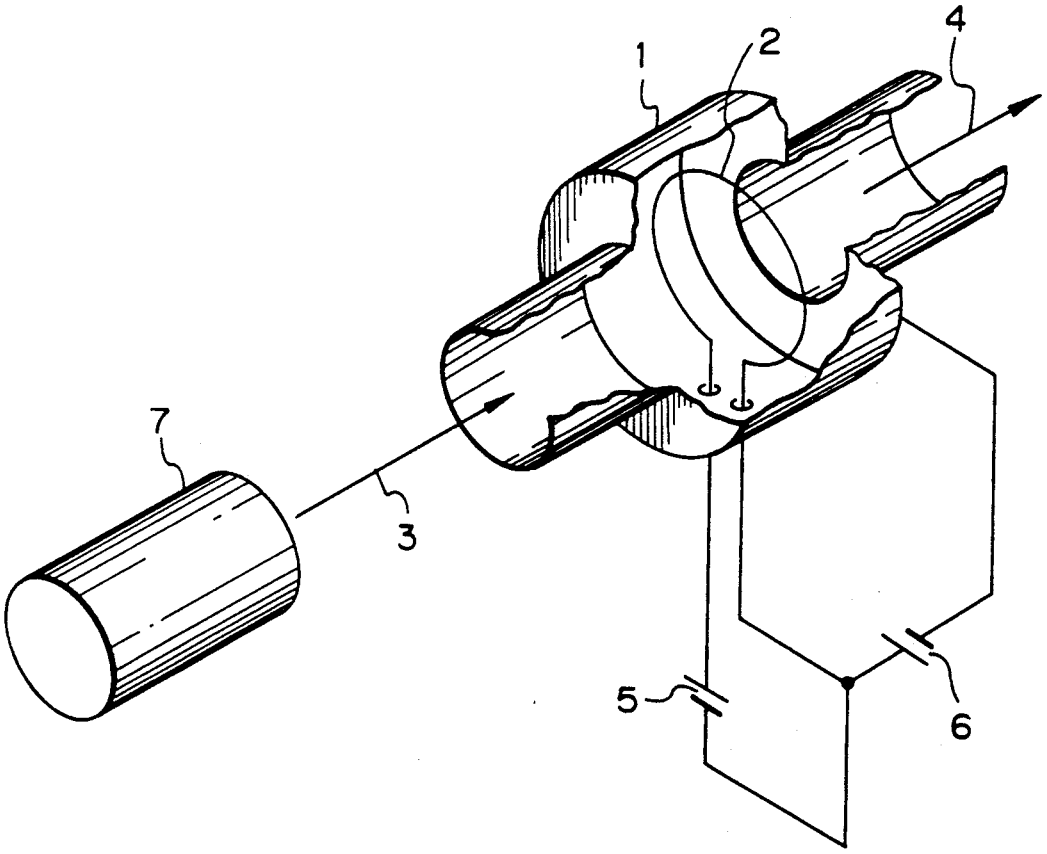
Fig. 4 (PRIOR ART)
FIG. 4 is a schematic diagram of a fast atom beam source according to the prior art.

It should be noted that in this embodiment constituent elements having the same functions as those in the prior art described above in connection with FIG. 4 are denoted by the same reference numerals and a detailed description thereof is omitted.

In FIG. 1, reference numeral 21 denotes an electron accelerating grid, 23 an electron beam, 24 an electron accelerating power supply, 26 an ion beam entrance orifice provided in a casing 27, and 28 a fast atom beam exit orifice formed in the casing 27, as in the case of the ion beam entrance orifice 26, at an end of the casing 27 which faces the entrance orifice 26.

The electron accelerating grid 21 is disposed in the casing 27 in such a manner that it extends, with an approximately funnel-like configuration, at a position which is forward of the circular filament 2 and at which the accelerating grid 21 faces the exit orifice 28. The accelerating grid 21 is arranged such that the ion beam 3 can pass through the central portion thereof and the grid 21 accelerates the electron beam 23 emitted from the circular filament 2 while converging it toward the ion beam 3.

The electron accelerating power supply 24 is connected between the filament 2 and the electron accelerating grid 21 to bias the grid 21 to a potential which is somewhat higher than that of the filament 2.

It should be noted that the casing 27 is electrically connected to the electron accelerating grid 21 so as to be equal in potential to the latter.

In this embodiment, the filament 2 and the electron accelerating grid 21 constitute in combination an electron gun.

It should be noted that in this embodiment illustration of the above-described filament heating power supply (denote by reference numeral 5 in FIG. 4) is omitted for simplification of the drawing.

The operation of the fast atom beam source arranged as described above will next be explained.

The ion beam 3 is emitted from the ion source 7 and enters the casing 7 through the ion entrance orifice 26. At this time, the circular filament 2 is heated until red to produce thermal electrons, which are accelerated by the electron accelerating grid 21 to form an electron beam 23. The electron beam 23 is converged toward the ion beam 3 entering through the ion entrance orifice 26 by virtue of the above-described configuration of the electron accelerating grid 21. Thus, the ions in the ion beam 3 recombine with the electrons in the electron beam 23 and return to atoms. During the recombination, the ions deliver the kinetic energy to the atoms without a significant loss of energy, thus forming a fast atom beam 4 with large kinetic energy, which is then emitted to the outside of the casing 27 through the fast atom beam exit orifice 28.

In the above-described process, if the electron accelerating power supply 24 is controlled so that the speed of the electron beam 23 is substantially equal to the speed of the ion beam 3, the recombination cross section between ions and electrons increases, so that the production efficiency of the fast atom beam 4 is improved. In addition, if the red-head temperature of the filament 2 is controlled so that the number of electrons in the recombination space is sufficiently larger than the number of ions, the fast atom beam production efficiency is further improved.

Figure 2:
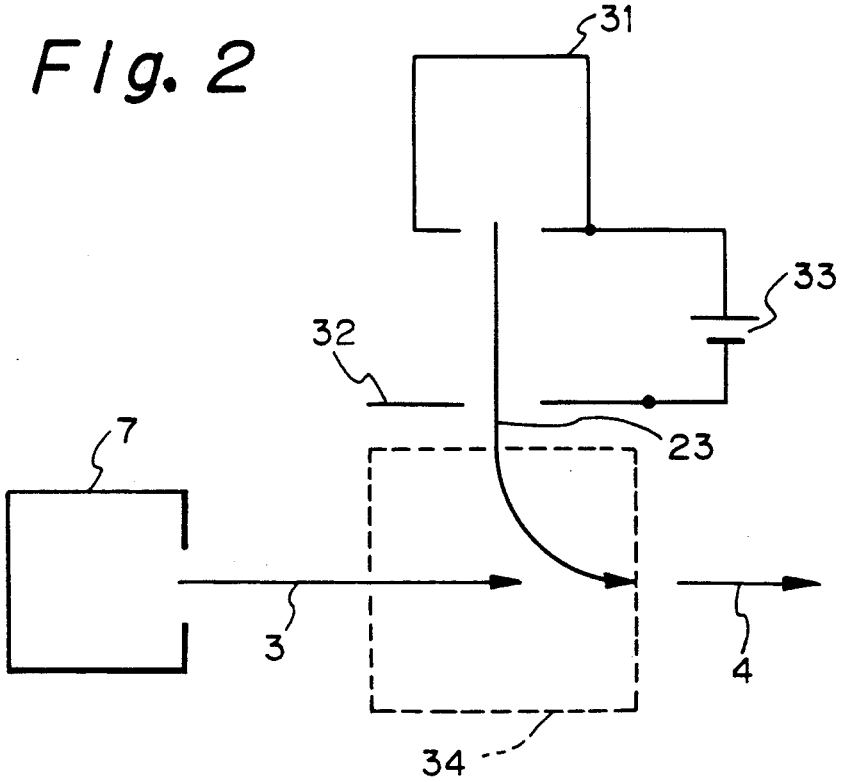
FIG. 2 is a schematic diagram of another embodiment of a fast atom beam source according to the present invention.

FIG. 2 shows another embodiment of the present invention, in which electrons are added to argon ions with an energy of about 10 KeV, for example, thereby producing a fast atom beam of argon.

It should be noted that in this embodiment also constituent elements having the same functions as those in the embodiment described above in connection with FIG. 1 are denoted by the same reference numerals and a detailed description thereof is omitted.

In FIG. 2, reference numeral 31 denotes an electron gun that emits an electron beam 23 at approximately right angles to an ion beam 3 emitted from an ion source 7, 32 a retarding electrode that decelerates electrons, and 33 a retarding power supply that applies a voltage to the retarding electrode 32, the power supply 33 constituting, together with the retarding electrode 32, a speed control means for controlling the speed of the electron beam emitted from the electron gun 31 to a level substantially equal to the speed of the ions in the ion beam 3. Reference numeral 34 denotes a magnet serving as a deflection means that deflects the decelerated electron beam 23 so that the electron beam 23 is aligned with the direction of the ion beam 3 and then mixed with it.

The magnet 34 is disposed at a position where the ion beam 3 emitted from the ion source 7 and the electron beam 34 from the electron gun 31 intersect each other, to apply a magnetic field in a direction normal to the plane of the figure. The retarding electrode 32 is disposed in between the electron bun 31 and the magnet 34 at a position which is closer to the magnet 34 than to the electron gun 31.

It should be noted that the electron gun 31 has a conventional structure including a heating filament and an accelerating electrode substantially similar to that in the foregoing embodiment.

In addition, the constituent elements, exclusive of the retarding power supply 33, are accommodated in a vacuum container (not shown).

The operation of this fast atom beam source will next be explained.

The speed U of ions with a kinetic energy $eV_1$ and a mass M and the speed u of electrons with a kinetic energy $eV_2$ and a mass m are given by $$U = \sqrt{(2eV_1/M)} \quad (1)$$

$$u = \sqrt{(2eV_2/m)} \quad (2)$$

In the present invention, the condition of U=u must be satisfied, and hence, $$V_1V_2 = M/m \quad (3)$$

Since the mass M of argon ions with an energy of 10 KeV is about 70,000 times the mass m of electrons, if the energy of the electrons is 1/70,000 of the energy of the argon ions, i.e., about 0.14 eV, the argon ions and the electrons are equal in speed to each other.

In general, electrons that are produced from the electron gun 31 have an energy of several 100 eV or more. It is difficult to produce electrons with an energy below that level directly from the electron gun 31 due to the space-charge effect. Accordingly, it is necessary in order to obtain electrons of 0.14 eV to form an electric field in between the electron gun 31 and the retarding electrode 32 by the retarding power supply 32 to decelerate electrons with a high level of energy (i.e., high speed).

Thus, the electron beam 23 controlled to a predetermined speed enters the magnetic field, which is applied in a direction normal to the plane of the figure by the magnet 34, whereby the orbit of the electron beam 23 is deflected so that the electron beam 23 is aligned with the direction of travel of the ion beam 3, and thereafter the electron beam 23 is mixed with the ion beam 3. Thus, a fast atom beam 4 of argon is produced.

Figure 3:
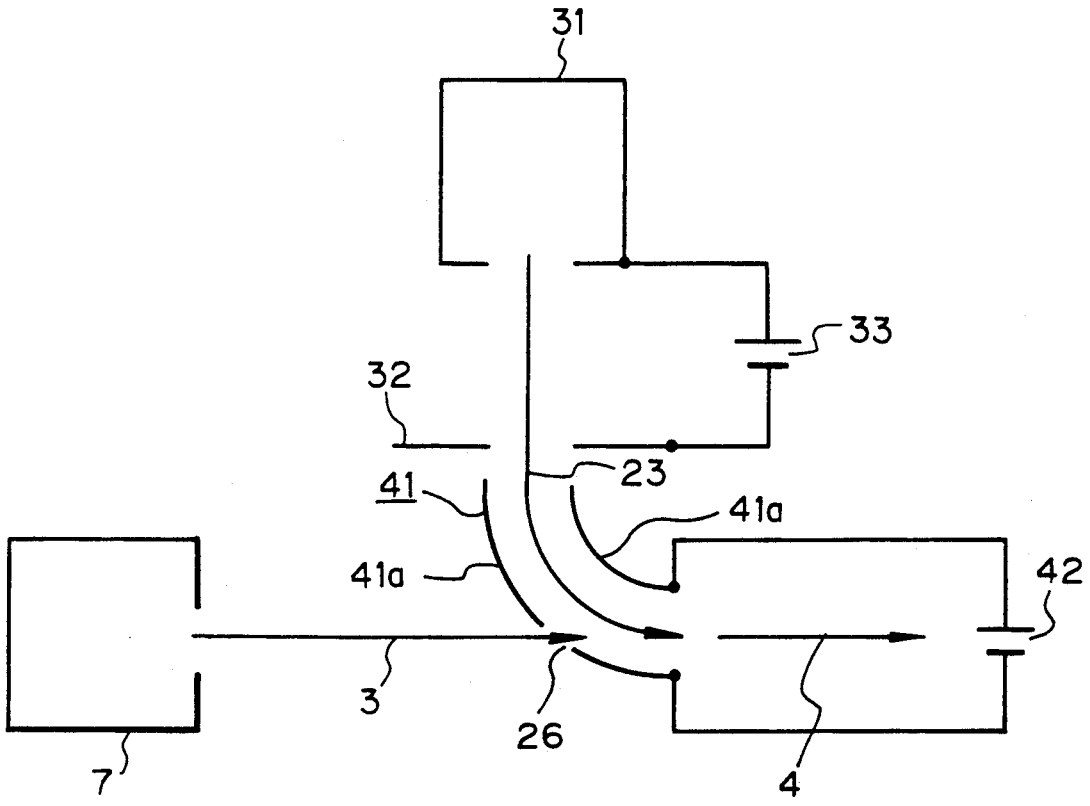
FIG. 3 is a schematic diagram of still another embodiment of a fast atom beam source according to the present invention.

FIG. 3 shows still another embodiment of the present invention, in which electrons are added to argon ions with an energy of about 10 KeV to produce a fast atom beam of argon.

It should be noted that in this embodiment constituent elements having the same functions as those in the embodiment described above in conjunction with FIG. 2 are denoted by the same reference numerals.

In the figure, reference numeral 41 denotes an electrostatic deflector for electrons which comprises two opposing arcuate electrodes 41*a*. The surface of the outer arcuate electrode 41*a* is provided with an ion entrance orifice 26 to allow an ion beam 3 to enter the deflector therethrough. The two arcuate electrodes 41*a* are disposed such that an electron beam 23 is emitted into the area defined therebetween. Reference numeral 42 denotes a deflection power supply that is connected to the electron deflector 41.

The operation of the fast atom beam source arranged as described above is the same as that of the embodiment shown in FIG. 2 up to the step in which the electron gun 31 produces an electron beam 23 which is substantially equal in speed to argon ions.

In this embodiment, the electron beam 23 enters the electrostatic deflection field that is formed by the electron deflector 41, in which the orbit of the electron beam 23 is deflected so that the electron beam 23 is aligned with the direction of travel of the ion beam 3 by the action of the electric field. In this state, the argon ion beam 3 passing through the ion entrance orifice 26 is incident on the electron beam 23, thereby producing a fast atom beam 4 or argon.

As has been described above, according to the fast atom beam source of the present invention, ions and electrons are mixed together after their speeds have been equalized with each other, so that the recombination cross section between ions and electrons increases and hence the recombination chance increases, resulting in an improvement in the production efficiency of the fast atom beam.

The fast atom beam produced in this way can be utilized for thin film formation by sputtering deposition, fine pattern processing by sputtering etching, and material evaluation by secondary ion mass analysis in the same way as in the case of energetic ion beam. In addition, since the fast atom beam is chargeless, it can be applied not only to metals and semiconductors but also to insulators such as plastics, ceramics, etc., to which the ion beam technique cannot effectively be applied. In this sense, the present invention, which provides a fast atom beam source that emits a fast atom beam efficiently, is very useful for improving the efficiency of processing and analysis.

What is claimed is:

1. Apparatus for producing a fast atom beam, said apparatus comprising: an ion source which emits an ion beam in the apparatus; and an electron gun including a filament extending in a circle around a path along which the ion beam travels in the apparatus such that an ion beam emitted by said ion source will pass through the space defined within the filament, a heating power supply operatively connected to said filament so as to heat said filament to such a degree that a beam of thermal electrons is released therefrom, an electron grid having a funnel-like structure with a central portion defining the apex thereof, the central portion of said grid being provided in the path along which the ion beam travels in the apparatus such that an ion beam emitted by said ion source will also pass through the central portion of said grid, said central portion of the funnel-like grid constituting an upstream end of said grid with respect to the direction in which the electron beam travels such that said electron grid converges the beam of electrons released from said filament toward the ion beam, and an electron accelerating power supply means for biasing said electron grid to a potential which is so much higher than that of said filament that the grid accelerates the beam of electrons released from said filament toward said ion beam to a speed substantially equal to that of the ions of the ion beam such that the ions of the ion beam combine with the electron beam and return to atoms without a significant loss in kinetic energy to thereby form a fast atom beam with large kinetic energy.

2. Apparatus for producing a fast atom beam, said apparatus comprising: an ion source which emits an ion beam in the apparatus; an electron gun which emits an electron beam in the apparatus that travels in a direction different from that in which the ion beam travels; speed control means for regulating the speed of electrons of the electron beam emitted by said electron gun to a level substantially equal to that of the speed of the ions of the ion beam emitted by said ion beam source; and deflecting means for deflecting the electron beam into alignment with the ion beam such that the ions of the ion beam combine with the electron beam and return to atoms without a significant loss in kinetic energy to thereby form a fast atom beam with large kinetic energy, said deflecting means comprising inner and outer arcuate electrodes, said electrodes having first terminals ends, respectively, defining an electron beam entrance of the deflecting means, and second terminal ends, respectively, defining a beam exit of said deflecting means, said arcuate electrodes being spaced from one another and oriented the same with respect to the curvature thereof so as taken from said beam entrance to said beam exit, said outer arcuate electrode having an orifice located in a path along which the ion beam travels in the apparatus such that an ion beam emitted by said ion orifice will pass through said outer arcuate electrode via said orifice and into the area defined between said opposing arcuate electrodes, and said opposing arcuate electrodes being so disposed in the apparatus that the electron beam emitted by said electron gun passes through said electron beam entrance of the deflecting means and also into the area defined between the electrodes.

3. Apparatus for producing a fast atom beam as claimed in claim 2, wherein said electron gun emits a beam of thermal electrons at a right angle to the ion beam.

4. Apparatus for producing a fast atom beam as claimed in claim 2, wherein the arcuate central axis of the area defined between said electrodes is tangential to the path along which ion beam enters said area through the orifice of said outer arcuate electrode.

5. Apparatus for producing a fast atom beam as claimed in claim 3 wherein the arcuate central axis of the area defined between said electrodes is tangential to the path along which ion beam enters said area through the orifice of said outer arcuate electrode.

* * * * *